United States Patent [19]

Nagaishi et al.

[11] Patent Number: 4,949,694

[45] Date of Patent: Aug. 21, 1990

[54] FUEL SUPPLY CONTROL SYSTEM FOR INTERNAL COMBUSTION ENGINE

[75] Inventors: Hatsuo Nagaishi, Zushi City; Hiromichi Miwa; Toyoaki Nakagawa, both of Yokohama, all of Japan

[73] Assignee: Nissan Motor Co., Ltd., Yokohama, Japan

[21] Appl. No.: 343,204

[22] Filed: Apr. 26, 1989

[30] Foreign Application Priority Data

| | | | |
|---|---|---|---|
| Apr. 26, 1988 | [JP] | Japan | 63-105091 |
| Apr. 26, 1988 | [JP] | Japan | 63-105092 |
| May 17, 1988 | [JP] | Japan | 63-121254 |
| May 17, 1988 | [JP] | Japan | 63-121255 |
| May 18, 1988 | [JP] | Japan | 63-122523 |
| May 19, 1988 | [JP] | Japan | 63-123688 |

[51] Int. Cl.[5] ..... F02D 41/18; F02D 41/26

[52] U.S. Cl. ..... 123/494; 123/480; 123/486

[58] Field of Search ..... 123/478, 480, 486, 494; 364/431.05

[56] References Cited

U.S. PATENT DOCUMENTS

| | | | |
|---|---|---|---|
| 4,091,773 | 5/1978 | Gunda | 123/478 X |
| 4,275,694 | 6/1981 | Nagaishi | 123/478 X |
| 4,311,042 | 1/1982 | Hosoya et al. | 123/478 |
| 4,404,946 | 9/1983 | Hoard et al. | 123/478 X |
| 4,425,890 | 1/1984 | Yamaguchi | 123/480 X |
| 4,706,631 | 11/9187 | Wataya | 123/488 |
| 4,712,529 | 12/1987 | Terasaka et al. | 123/492 |
| 4,718,388 | 1/1988 | Kiuchi | 123/478 |
| 4,817,571 | 4/1989 | Morita et al. | 123/492 |

FOREIGN PATENT DOCUMENTS

| | | |
|---|---|---|
| 0217391 | 4/1987 | European Pat. Off. . |
| 0258864 | 3/1988 | European Pat. Off. . |
| 3721910 | 1/1988 | Fed. Rep. of Germany . |
| 58-144631 | 8/1983 | Japan . |
| 58-144632 | 8/1983 | Japan . |
| 58-144633 | 8/1983 | Japan . |
| 59-83048 | 5/1984 | Japan . |
| 60-162066 | 8/1985 | Japan . |
| 2181570 | 4/1987 | United Kingdom . |

*Primary Examiner*—Willis R. Wolfe

*Attorney, Agent, or Firm*—Foley & Lardner, Schwartz, Jeffery, Schwaab, Mack, Blumenthal & Evans

[57] ABSTRACT

In order to obviate the dely between a demand for transitory engine operation and the injection of the appropriate amount of fuel, an initial correction pulse width is generated in response to the change in throttle valve position is added to a basic width which is developed based on the output of an air flow meter located in an upstream section of the induction conduit. The system further provides for continuously updating correction factors which are applied to the throttle sensor to ensure linearity and generating weighting factors and the like which are appropriately applied to improve the air-fuel control.

10 Claims, 16 Drawing Sheets

FIG. 25
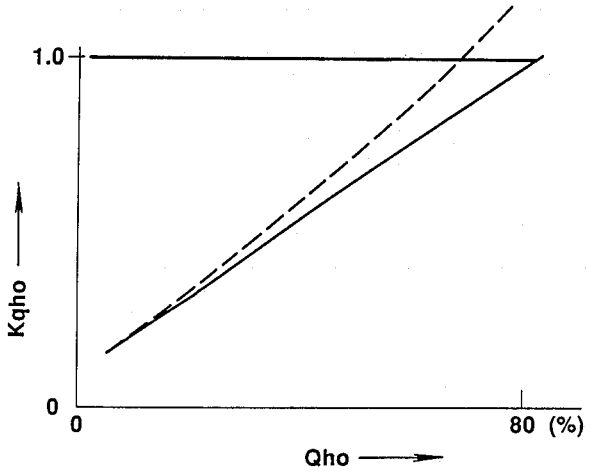
FIG. 26A
FIG. 26B
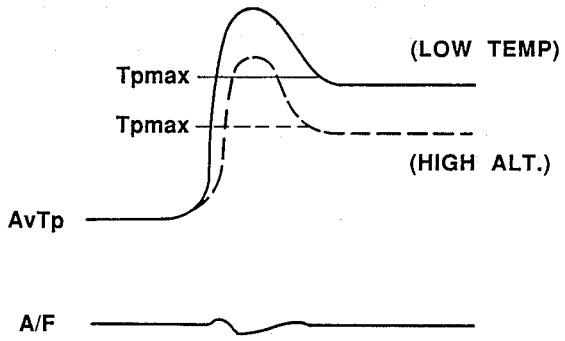

FUEL SUPPLY CONTROL SYSTEM FOR INTERNAL COMBUSTION ENGINE

BACKGROUND OF THE INVENTION

1. Field of the Invention

The present invention relates to internal combustion engines and more specifically to a fuel supply arrangement therefore.

2. Description of the Prior Art

It is a commonly sought goal to be able to operate an internal combustion engine in a manner which suppress noxious emissions, produces high power and achieve good fuel economy. It is also desired to maintain these characteristics during acceleration and other transient modes of operation.

In order to control the air-fuel ratio with the above objects in mind, previously proposed arrangements have used air flow meters to determine the amount of air being inducted into the engine. However, these arrangements have failed to effect calculations which take into account the volume of the section of the induction passage located between the source of fuel (viz., fuel injector) and the air flow sensor and in particular have not made wall flow corrections.

Accordingly, during transitory modes of operation a dely in the injection characteristics required for the instant operating conditions has occurred and deteriorated engine response and performance.

SUMMARY OF THE INVENTION

It is an object of the present invention to provide a fuel supply system which is highly responsive to demands for transient engine operation, which prevents injection overshoot during the initial stages of the transient mode and which accurately controls the air-fuel ratio in a manner which suppresses the level of noxious emissions from the engine.

In brief, the above object is acheived by an arrangement wherein an initial correction pulse width is generated in response to the change in throttle valve position is added to a basic pulse width which is developed based on the output of an air flow meter located in an upsteam section of the induction conduit. The arrangement further provides for continuously updating correction factors which are applied to the throttle sensor to ensure linearity and generating weighting factors and the like which are appropriately applied to improve the air-fuel control.

More specifically, a first aspect of the present invention is deemed to comprise a method of operating an internal combustion engine, the method featuring the steps of: sensing the amount of air flowing in an induction conduit using an air-flow meter; throttling of said induction conduit using a throttle valve, said throttle valve being disposed in said air induction conduit at a location downstream of said air-flow meter; sensing the position of said throttle valve using a throttle valve position sensor, said throttle valve position sensor being operatively connected with said throttle valve and arranged to output a signal indicative of the opening degree thereof; injecting fuel into said induction conduit using a fuel injector, said fuel injector being disposed in said air induction conduit at a location proximate the downstream end thereof; sensing the rotational speed of said engine using a rotational speed sensor, said rotational speed sensor being operatively connected with said engine and arranged to output a signal indicative of the rotational speed thereof; deriving a basic injection pulse width (Tp) based on the output of said air-flow meter and said engine speed sensor (Qa/N); deriving an air induction amount (Qho) based on the output of said throttle valve position sensor and said rotational speed sensor (TVO/N); smoothing the result of the basic injection pulse width derivation using a smoothing factor which varies with the output of said engine speed and said derived air induction amount; deriving a correction pulse width based on the change in a first intermediate value (TTHSTP) which varies with said rotational speed sensor output and said derived air induction amount; and adding the correction pulse width to said basic pulse width to derive a corrected pulse width (AvTp); and limiting the maximum value of said corrected pulse width to a maximum value (Tpmax).

A second aspect of the present invention is deemed to comprise an internal combustion engine which features: an air-flow meter, said air-flow meter being disposed in an air induction conduit of the engine; a throttle valve, said throttle valve being disposed in said air induction conduit at a location downstream of said air-flow meter; a throttle valve position sensor, said throttle valve sensor being operatively connected with said throttle valve and arranged to output a signal indicative of the opening degree of said throttle valve; a fuel injector, said fuel injector being disposed in said air induction conduit at a location proximate the downstream end thereof; a rotational speed sensor, said rotational speed sensor being operatively connected with said engine and arranged to output a signal indicative of the rotational speed of said engine; a control circuit, said control circuit including circuitry responsive to said air flow meter and said throttle valve position sensor, said control circuit further including means for: deriving a basic injection pulse width (Tp) based on the output of said air-flow meter and said engine speed sensor (Qa/N); deriving an air induction amount (Qho) based on the output of said throttle valve position sensor and said rotational speed sensor (TVO/N); smoothing the result of the basic injection pulse width derivation using a smoothing factor which varies with the output of said engine speed and said derived air induction amount; deriving a correction pulse width based on the change in a first intermediate value (TTHSTP) which varies with said rotational speed sensor output and said derived air induction amount; and adding the correction pulse width to said basic pulse width to derive a corrected pulse width (AvTp); limiting the maximum value of said corrected pulse width to a maximum value (Tpmax).

BRIEF DESCRIPTION OF THE DRAWINGS

FIGS. 23 to 25 are look-up tables which used in connection with the seventh and eighth embodiments; and FIGS. 26, A and B timing charts showing the type of air-fuel (A/F) control which is possible with the present invention.

DETAILED DESCRIPTION OF THE PREFERRED EMBODIMENTS

Figure 1:
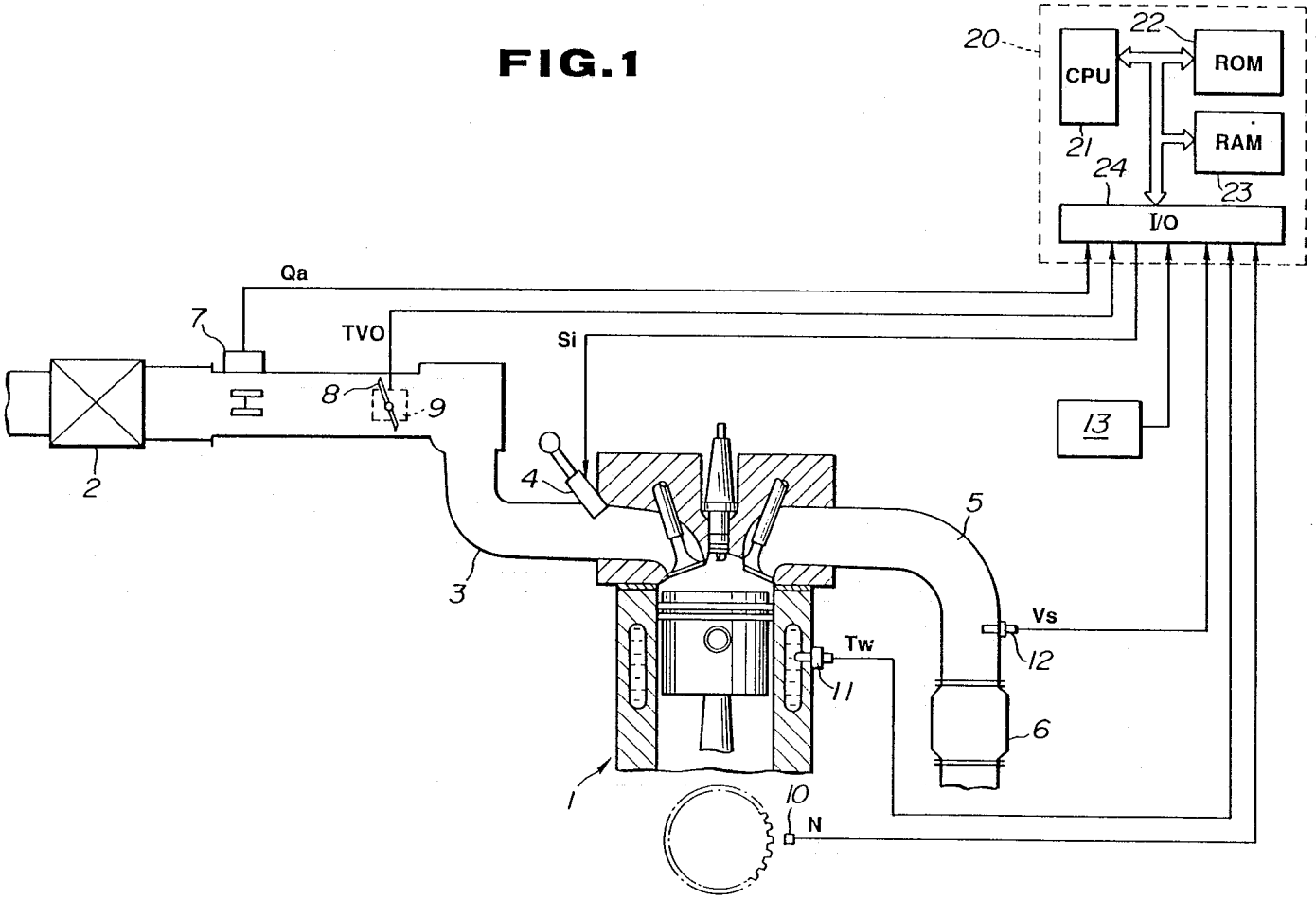
FIG. 1 is a schematic showing an engine system to which the embodiments of the present invention are applied.

FIG. 1 shows an engine system to which the embodiments of the present invention are applied. As show, this arrangement includes an internal combustion engine 1, and air cleaner which is disposed at the upstream end of an induction passage or conduit 3. Fuel injectors 4 (only one shown) are arranged to inject fuel into the induction passage at a location proximate the inlet valves and the combustion chamber of the engine.

An exhaust conduit 5 includes a catalytic converter 6. In this instance the converter takes the form of a so called three way type which is capable of simultaneously reducing CO, HC and NOx.

A hot wire type air flow meter 7 is disposed in the induction conduit 3 at a location between the air cleaner 2 and a throttle valve 8.

It should be noted that the present invention is not limited to the use of hot-wire type air-flow meters and that any other suitable device can be used if so desired. For example, a hot film or flap type air flow meters may be alternatively used if so desired. However, induction vacuum sensors are not deemed appropriate in this instance.

A throttle valve position sensor 9 is operatively connected with the throttle valve 8 and arranged to produce a signal TVO which is indicative of the throttle opening.

An engine rotational speed sensor 10 is arranged to generate a rotational speed signal N while a coolant temperature sensor is arranged to produce a signal Tw.

An air-fuel ratio sensor 12 is disposed in the exhaust conduit and arranged to be responsive to the amount of oxygen contained in the exhaust gases. In this instance the sensor is of the type which produces a sudden change in output voltage in response to exposure to combustion gases which result from the combustion of a stoichiometric air-fuel mixture.

An engine idle switch 13 is arranged to produce a signal indicative of the engine having entered an idling mode of operation. This switch can be arranged to operated in response to the throttle valve assuming a fully closed position, the accelerator pedal assuming a fully released condition or the like.

A control unit 20 is arranged to received data input signals form the above mentioned sensor devices and to include a microprocessor. Merely by way of example, this microprocessor includes a CPU 21, a ROM 22, a RAM 23 and an I/O board 24.

Figure 4:
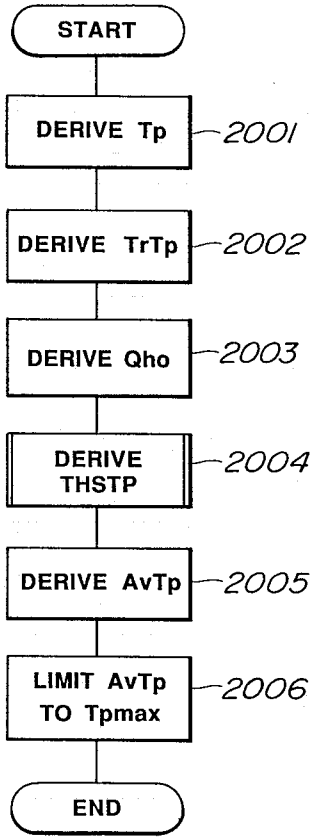
FIG. 4 is a flow chart showing the main control routine which incorporates the sub-routine shown in FIG. 2.

FIG. 4 shows a main routine which includes a subroutine in which THSTP is calculated. It will be noted that the instant routine is run at predetermined intervals, for example 10 ms.

Figure 2:
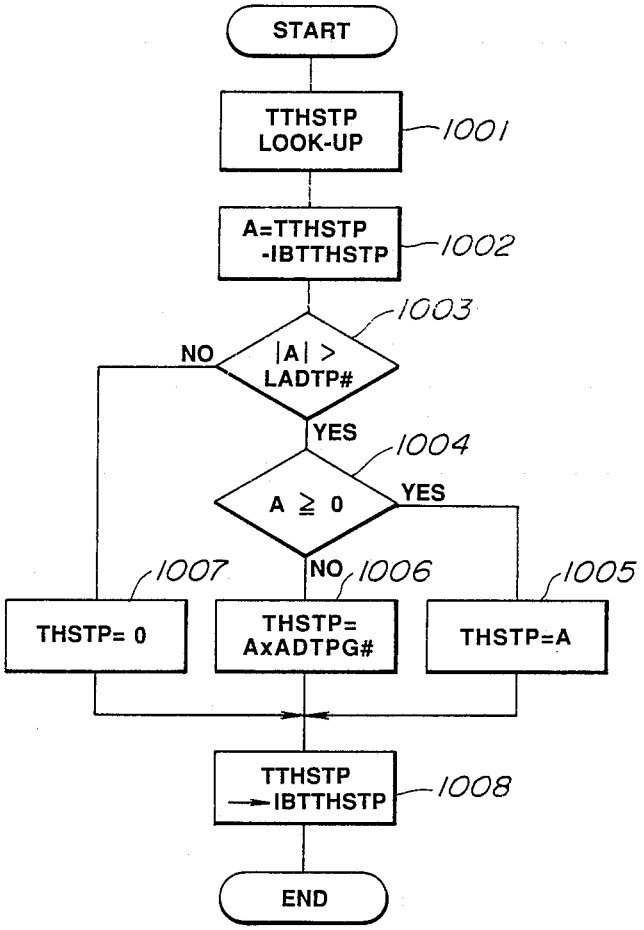
FIG. 2 is a flow chart showing the steps which are performed in a sub-routine run accordance with a first embodiment of the invention and which derives a correction factor THSTP which is used to obviate the injection control delay which tends to occur at the initial stages of a transitory mode of operation.
Figure 3:
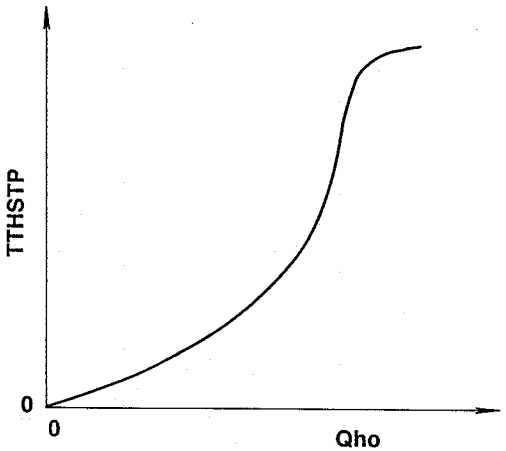
FIG. 3 is a look-up table wherein a variable TTHSTP which is used to derive the above mentioned THSTP value is recorded in terms of Gho, the induction quantity as determined using engine throttle valve and engine speed parameters.

FIG. 2 shows the sub-routine in which the value of the primary or initial correction injection pulse width THSTP is derived. At the first step 1001 of this routine the amount of air ( $\alpha$—N induction volume Qho) which is being inducted into the engine is derived using the instant throttle valve and engine speed signals TVO, N and this value then used with table data of the nature depicted in FIG. 3 in order to derive a value of TTHSTP.

At step 1002 the difference A between the instant value of TTHSTP and that derived in the previous run of the routine is derived and at step 1003 the absolute value thereof (viz., $|A|$) is compared with a predetermined correction decision level value LADTP#. In the event that the absolute value of A is greater than LADTP# then transient engine operation is indicated and at step 1004, A is compared with zero. In the event that A is greater or equal to zero then acceleration (positive laod) is indicated and the routine flows to step 1005 wherein the value of THSTP is set to equal the instant value of A.

On the other hand, in the event that the value of A is less than zero then deceleration or negative load is indicated and the routine flows to step 1006 wherein the value of THSTP is derived using the equation:

$$THSTP = A \times ADTPG\# \quad (1)$$

Wherein ADTGP# is a speed reduction amendment ratio.

However, in the event that |A| is less than or equal to LADTP# then the engine is indicated as undergoing either weak acceleration or non-transitory operation and the routine flows to step 1007 wherein the value of THSTP is set to zero.

At step 1008 the value of TTSTP which as derived in step 1001 during the instant run of the sub-routine, is set in memory ready for the next run.

FIG. 4 shows in flow chart form the steps which characterize the main control routine used to derive the smoothed or averaged injection pulse width AvTp. As mentioned above this derivation is carried out at 10 ms intervals. Firstly at step 2001 the basic injection pulse width Tpo is derived using the following equations:

$$Tpo = Qa/N \times K \quad (2)$$

Wherein

K: is a constant;

Qa: is the output of the air flow meter 7; and

N: is engine speed signal generated by engine speed sensor 10.

Figure 5A:
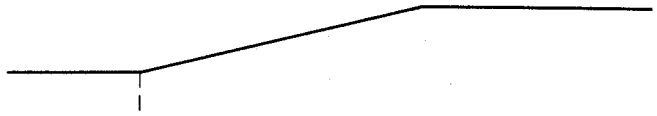
FIGS. 5, A-F timing charts showing the relationships which develop between the injection pulse widths derived using the output of an air flow meter, the air flow as derived using engine speed and throttle position, THSTP and AvTp, a value derived using the above mentioned data and which is vital to the derivation of the final injection pulse width.
Figure 5B:
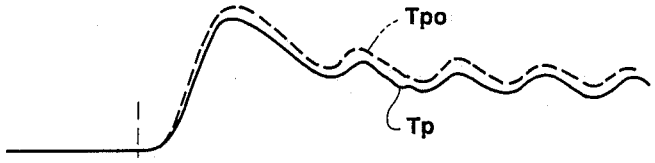
Figure 5C:
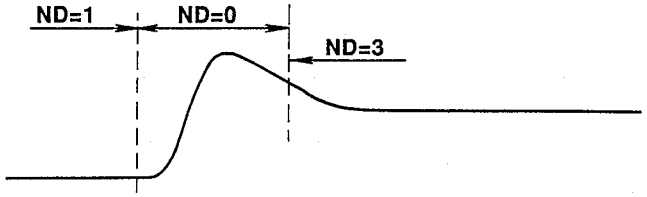

Tp is then obtained by determining the weighted average of Tpo. Accordingly, as shown by the solid line trace in FIG. 5(B) the error in the Tp value due to fluctuation is reduced.

Next, at step 2002 TrTp' is derived using the following equation.

$$TrTp' = Tp \times Kflat \quad (3)$$

Wherein Kflat is a flat A/F correction factor which is obtained from data mapped in terms of engine speed N and α−N induction volume Qho. Viz., as the fluctuation error in the H/W (hot wire air-flow meter) output varies with the amount of air flow, and is susceptible to the change in the ambient atmospheric pressure and temperature, in the instant embodiment the value of Tp is corrected using the Kflat factor.

In order to modify the value of TrTp' such as under WOT (wide open throttle) operating conditions, for example, a smoothed basic pulse width TrTp is calculated. In this connection, a deviation smoothing index ND is applied.

During WOT modes of operation ND=3, during non-transient modes ND=2, idling modes ND=1 and during transient modes of operation ND=0. Accordingly, during transient modes the weighting index induces no change and, in effect, and TrTp' is used essentially unmodified.

In the case of WOT operation it is alternatively possible to use a weight factor which is ⅛ of the shifted weighted average.

Further discussion concerning the manner in which TrTp' is modified to derive TrTp will be given later.

It should be noted that it is possible to alternatively apply the Kflat factor and the weighting to the Tp value in lieu of the if so desired.

Figure 5D:
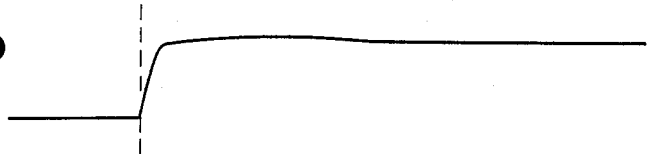

At step 2003 the instant values of the throttle position signal TVO and the engine speed N are read and used to derive a value of Qho (see FIG. 5(D)).

Figure 5E:
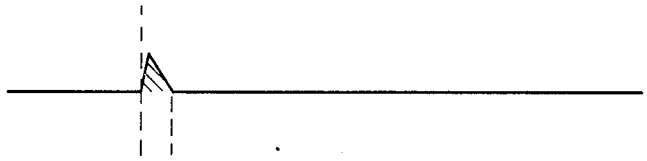

Next at step 2004 the sub-routine disclosed previously in connection with the flow chart shown in FIG. 2 is run in a manner to derive THSTP (see the hatched zone in FIG. 5E). This THSTP value is used to improve the injection volume during the initial stages of the throttle valve position changing.

Following this at step 2005 the equation (4) is used to derive the target injection pulse width AvTp.

$$AvTp = TrTp \times Fload + AvTp-1 \times (1 - Fload) + THSTP \quad (4)$$

where AvTp−1 is the value of AvTp obtained on the previous run and Fload is weighted averaging factor. During deceleration (only) Fload=Tfload+K2D. In this instance the value of Tfload can be taken from the data shown in FIG. 6 and modified by the addition of the K2D factor.

Figure 6:
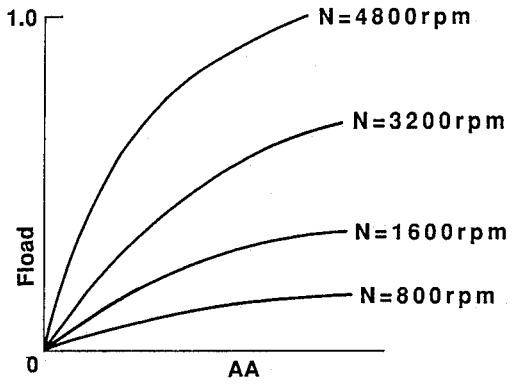
FIG. 6 is a Fload look-up map which is used in the first embodiment in order to obtain a weighting factor used in the derivation of AvTp.

FIG. 6 shows the map from which Fload is derived. As will be appreciated, this map is logged in terms of AA (the effective cross-sectional area of the induction passage as determined by the opening degree of the throttle valve) and a value NMV (the produce of the engine speed and engine displacement).

As will be appreciated the, first factor of equation (4) represents a basic injection value which has been corrected for fluctuations while the second one includes a value which exhibits a 10 ms dely due to the frequency with which the main and sub-routines are run. The third factor this equation includes a correction factor THSTP which compensates for the response delay which occurs during the initial moments of the transition period.

Next at step 2006 the derived value of AvTp is subject to limitation to a maximum value Tpmax and the routine ends.

In this embodiment Tpmax is derived by adding a degree of latitude or freedom YUTORI# to a table value of Ttpmax which is obtained from a map which is logged in terms of engine speed (see FIG. 24 by way of example) and to which a continuously updated air density factor Adenst is added. Viz:

$$Tpmax = Ttpmax \times Adenst + YUTORI\# \quad (5)$$

However, in this case Adenst is a ratio of WOT Tp and the table Ttpmax value. Viz:

$$Adenst = WOT\ Tp/Ttpmax \quad (6)$$

By substituting WOT Tp/Ttpmax for Adenst in equation (5) it can be shown that:

$$Tpmax = WOT\ Tp + YUTORI\# \quad (7)$$

The effect of adding Tp and THSTP is shown in FIG. 5. As will be noted there is a finite delay between the point in time at which the throttle valve position begins changing and the time where the values of Tpo and Tp begin to change. As will be further noted the value of TrTp (see FIG. 5C) - the basic pulse width which represents the flat A/F value derived from the correction of the Tpo and Tp wave forms, changes in a corresponding manner.

Figure 5F:
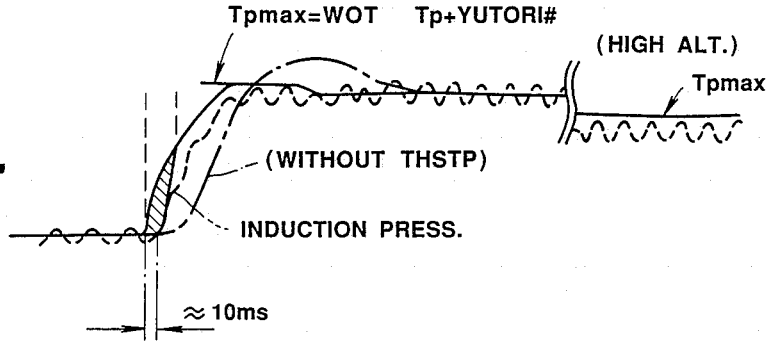

On the other hand, the $\alpha$—N induction volume Qho changes abruptly in a stepwise-like manner as shown in FIG. 5(D). FIG. 5(E) shows the timing with which the initial delay correction or compensation pulse width THSTP is derived and FIG. 5(F) shows the effect on the smoothed injection amount AvTp. For the sake of example, the phantom line trace shows AvTp as it would be without correction by THSTP, while the broken line wavy trace denotes the change in the induction pressure. This pressure approximates the amount of air flow at the site of the fuel injector.

It will also appreciated, the volume of air also effects the amount of fuel which reaches the wall of the induction passage.

As will be noted, the addition of the THSTP factor (shown in hatching) which provides correction for the first 10 ms of the transitional period in accordance with the present invention greatly reduces the delay in the injection response and brings it into close agreement with the change in Qho. The use of the Tpmax limit prevents overshoot and arrests the upper AvTp value in the manner shown in FIG. 5(F).

Figure 7A:
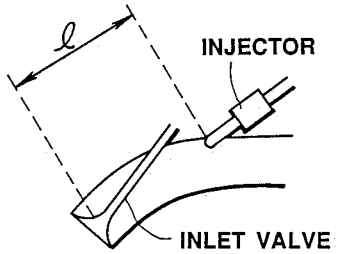
FIG. 7A is a schematic showing the distance between the fuel injector and the inlet valve.
Figure 7B:
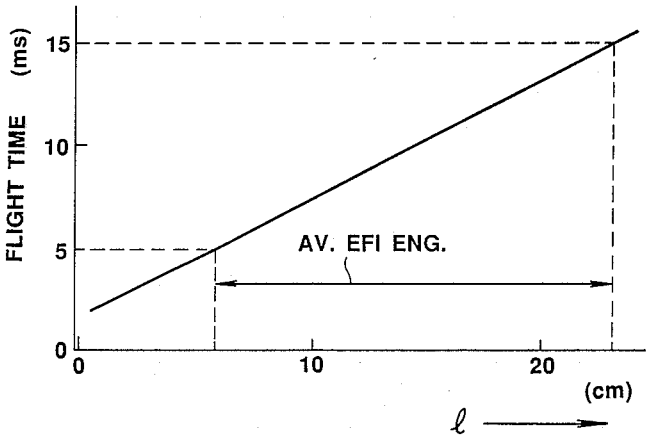
FIG. 7B is a chart showing the relationship between the fuel flight time and the distance between the injector and the valve.

The present invention is, of course not limited to correcting within the first 10 ms of the transitional mode and can be varied to an appropriate value in accordance with the distance between the injector and associated inlet valve (see FIG. 7(A). For example, as shown in FIG. 7(B) the normal injection delay (flight time) for a fuel injector, taking the induction vacuum and the distance between the injector and the inlet valve into consideration, is between 5 and 15 ms. By using the initial correction technique which characterizes the instant embodiment, the effect of this delay on the A/F can be obviated.

Figure 8:
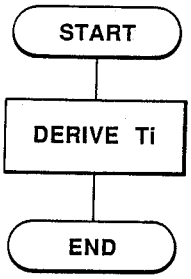
FIG. 8 is flow chart showing the routine via which the injection pulse Ti is derived.

FIG. 8 depicts the routine via which the final injection pulse width is derived. At the only step of this routine the following calculation is performed.

$$Ti=(AvTp\div Kathos)\times Tfbya\times \alpha+Ts \quad (8)$$

wherein -

Kathos: is the wall flow pulse width correction;

Tfbya: is the target A/F;

$\alpha$: is an air-fuel ratio feedback correction constant; and

Ts: is the rise time for the injector.

More specifically, Kathos allows for the effect of the delay in the fuel which flows along the walls of the induction conduit and enters the combustion chamber with a delay with respect to its actual injection, and includes a fuel velocity Vmf (ms) factor and a correction ratio Ghf (%) factor; $\alpha$ allows for the delay between the oxygen sensor 12 determining the air-fuel ratio (Lambda) of the exhaust gases at a location downstream of the cylinder and the injection which produced the combusted air-fuel mixture, and feeding a signal indicative of the same back to the control circuit 20; and Ts allows for the time between the injection pulse being applied to the injector and the actual opening of the same (viz., rise time).

Figure 19:
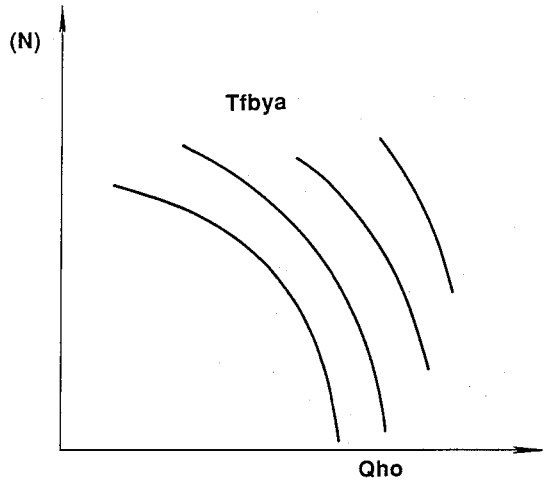
FIG. 19 is a look-up map used to derive a Tfbya factor.

The Tfbya value can be derived using a table look-up technique and data which is recorded in the form shown in FIG. 19, for example.

Following this calculation, the Ti is supplied to the I/O board and an injection control signal Si having the appropriate duty cycle and timing is issued.

Figure 9A:
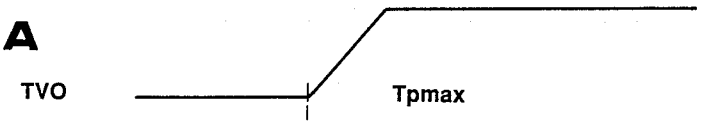
FIGS. 9, A-C timing charts showing the relationship between throttle position, AvTp and air-fuel ratio which occurs in accordance with the present invention.
Figure 9B:
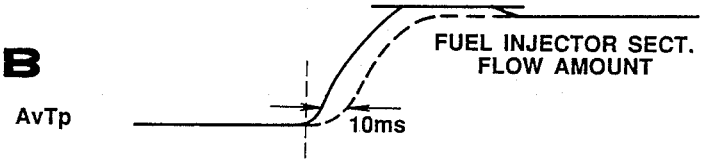
Figure 9C:
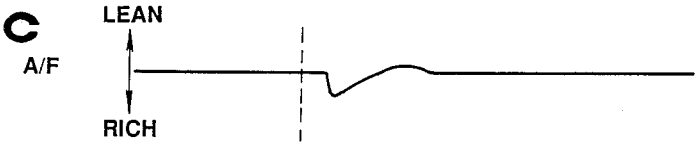

As shown in FIG. 9, in the case of sudden acceleration, the approximate 10 ms delay between the change in induction vacuum (which approximates the air flow at the injector site) is compensate for by the present invention and as the upper limit of the Tpmax is temporarily increased during this time large fluctuations in the resulting air-fuel mixture are prevented. This of course minimizes sudden increase in exhaust gas emissions.

SECOND EMBODIMENT

Figure 10:
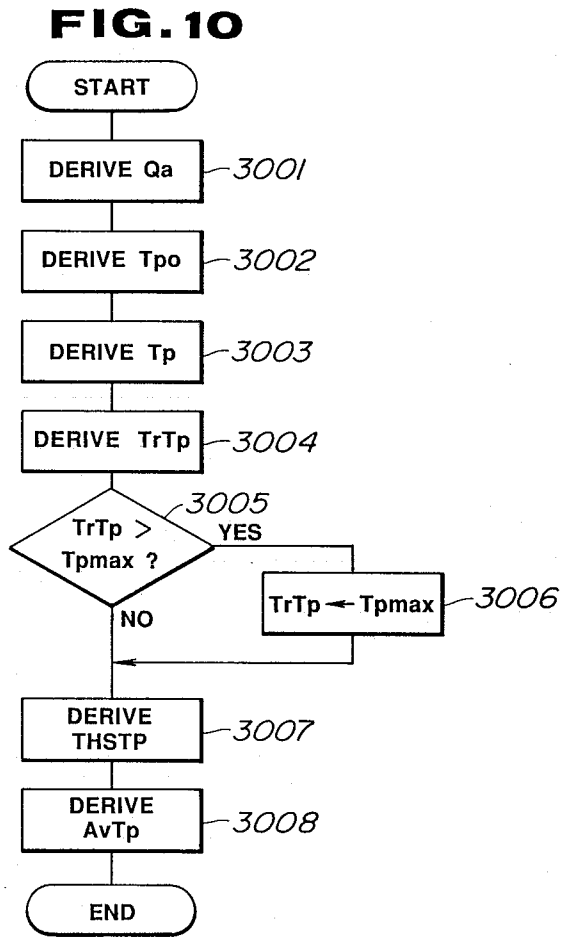
FIG. 10 is flow chart showing the steps via which AvTp is derived in accordance with a second embodiment of the present invention.
Figure 11:
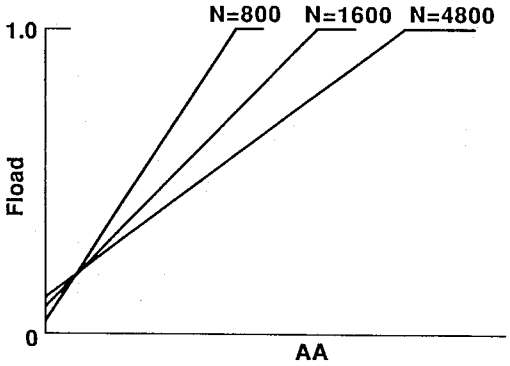
FIG. 11 is a look-up map used in the second embodiment to determine the weighting factor Fload.

FIG. 10 and 11 show a second embodiment of the present invention. This arrangement is essentially the same as the first and differs basically in that TrTp is derived and compared with Tpmax in step 3005. In the event that TrTp is the larger then the routine flows to step 3006 wherein TrTp is limited to the value of Tpmax. Other than this, the processes which are carried out are essentially the same as performed in the first embodiment and as such no further discussion is deemed necessary other than to point out that in this instance the Fload value used in equation (4) is derived using a table of the nature shown in FIG. 11.

THIRD EMBODIMENT

The third embodiment is such as to feature a self-learning characteristic which enables the accuracy of the system to be increased in a manner which compensates for minor changes from sensor to sensor which occur as a result of production and/or the passing of time. In brief, the air flow is measured by the air flow sensor 7 and compared with a value derived from throttle position and engine speed parameters. By comparing the two inputs during non-transitory states, improved correction based on the throttle position change during transient modes can be achieved.

Figure 12:
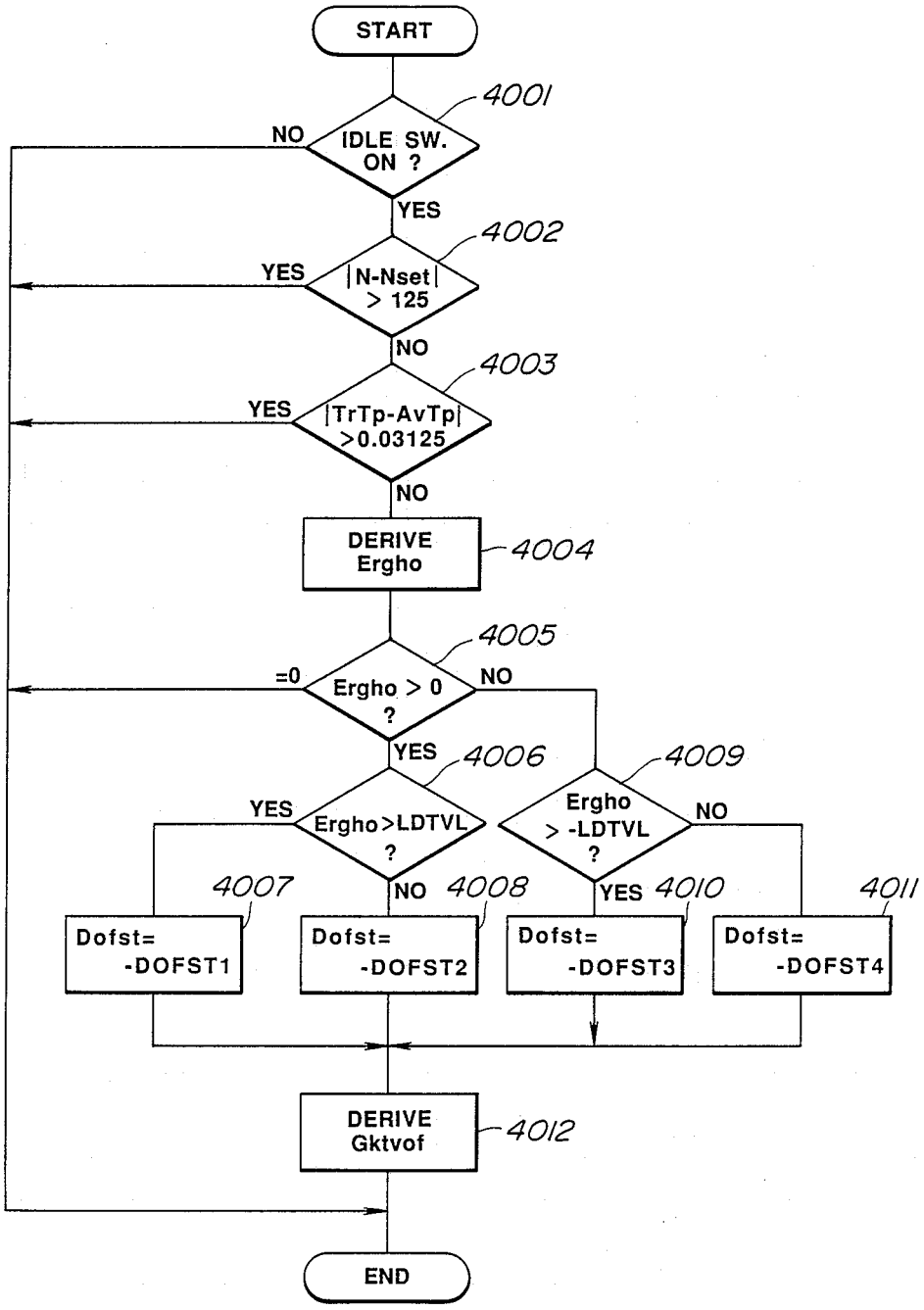
FIG. 12 is a flow chart showing the steps which characterize the procedure involved in the correction of the throttle valve position sensor output in accordance with a third embodiment of the present invention.

FIG. 12 shows in flow chart form a routine which derives a throttle valve opening degree offset value Gktvof. This routine is, in this embodiment, run at 10 ms intervals. In this routine the first step 4001 is such as to sample the output of the idle switch 13 and to determine if the engine is idling or not. If the idling switch is not on the routine ends. On the other had, if the idle switch is found to be ON then the routine flows to step 4002 wherein the absolute value of the difference between the instant engine speed N and a predetermined value Nset (target idle speed) is determined and compared with a predetermined value. In this case the value is 125 RPM. In the event the difference is less than 125 RPM it is assumed that the system is such as not to require correction and the routine ends. On the other hand, in the case the difference between N and Nset is greater than 125 RPM then the routine flows to steps 4003 wherein the absolute difference between TrTp and AvTp is compared with a value of 0.03125 [ms]. Viz:

$$|TrTp\cdot AvTp|>0.03125[\text{ms}] \quad (9)$$

In the event that the difference is less than or equal to 0.03125 then the engine can be assumed to be operating under non-transitional conditions and the routine flows to step 4004.

In this step the error Erqho in the $\alpha$—N induction volume Qho is determined using equation (10).

$$Erqho=Tp\times TGTVG\cdot Qho \quad (10)$$

wherein TGTNG is a fixed number which indicates the desired Qho/Tp ratio gain.

At step 4005 the value of Erqho just derived, is compared with zero. In the case Erqho is equal to zero the routine flows to end, while in the case it is greater than zero (viz., has a positive value) the routine flows to step 4006. In step 4006 the instant the instant value of Erqho is compared with a positive value of LDTVL. In this instance LDTVL denotes a predetermined value which is used to screen the values of Erqho. As shown in the event that Erqho>LDTVL then it is indicated that the discrepancy or deviation from the blue print value is large and at step 4007 wherein the instant value of Dofst (the value by which the Qho should be rewritten) is set equal to a first corrective amount −DOFST1. However, if Erqho<LDTVL then the routine flows to step 4008 wherein the amount of rewrite Dofst is set =−DOFST2.

On the other hand, in the event that Erqho has a negative value then at step 4009 Erqho is compared with a negative value of LDTVL. Depending on the outcome of this comparison, the value of Dofst is set either to −DOFST3 in step 4010 or −DOFST4 in step 4011. As will be appreciated Erqho>−LDTVL indicates a deviation on the large side.

At step 4012 the a called TVO offset correction amount Gktvof by which the idling Qho/Tp should be updated or revised by adding the value of Dofst obtained by the ranging of Erqho against LDTVL, is added to the value of Gktvof which was obtained on the last run of the instant sub-routine.

Figure 13:
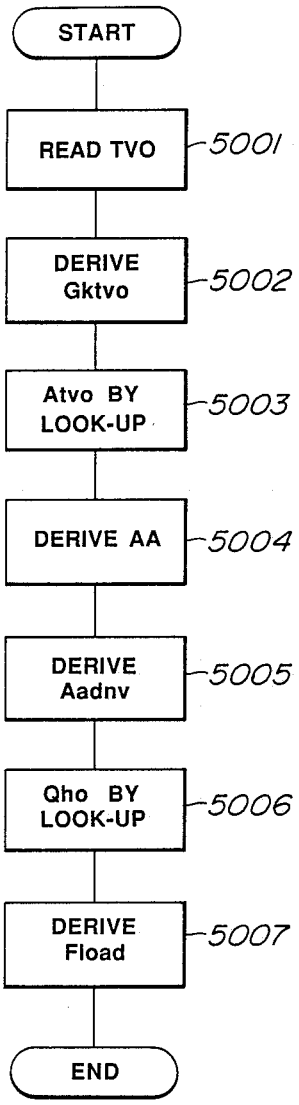
FIG. 13 is a flow chart which shows the process involved in deriving the Qho value in accordance with the present invention.

FIG. 13 is a flow chart showing the procedure followed by a main control routine which includes the Gktvof sub-routine described above in connection with the flow chart of FIG. 12.

A will be appreciated in the routine, the output of the throttle sensor 9 is read and the value of throttle position signal TVO is set in memory. Following this in step 5002 the TVO offset correction value or amount Gktvof is subtracted from the instant TVO value in a manner to derive a TVO offset correction result. Viz:

$$Gktvo = TVO - Gktvof \quad (11)$$

Following this, the Gktvo is used to perform a table-look up in a manner to derive a value Atvo which is indicative of the effective cross-sectional area which results from the instant throttle setting. Following this the actual (viz., total) effective cross-sectional area available for fluid flow AA is derived in step 5004. In this case AA is derived using equation (12)

$$AA = Atvo + Aisc \quad (12)$$

wherein Aisc is a ISC duty value (which is applied to a throttle chamber bypass passage control valve—not shown) derived by table look-up and which is dependent on coolant temperature.

Next, at step 5005 a value of Aadnv is derived.

$$Aadnv = AA/NMV \quad (13)$$

wherein NMV=N×engine displacement.

Finally, at step 5006 the AA and NMV are used to determine a weighted average Fload value via map look-up.

In this manner the output of the air flow meter (in this embodiment the basic injection pulse width Tp which is derived from the Qa signal) and amount of induction as indicated by Qho, are compared and if a comparison does not produce a predetermined ratio, the TVO signal is modified using the Gktvo factor so that even if the linearity of the throttle position sensor 7 is poor, an accurate æ−N induction volume Qho can be derived. This of course facilitates accurate generation of the initial correction injection pulse width THSTP at step 1001 of the flow chart shown in FIG. 2, or alternatively the derivation of Qho at steps 2003 (FIG. 4), step 3001 (FIG. 10), etc.

By way of example, the third embodiment utilizes the routines used in the second embodiment to derive the values of AvTp.

Figure 14:
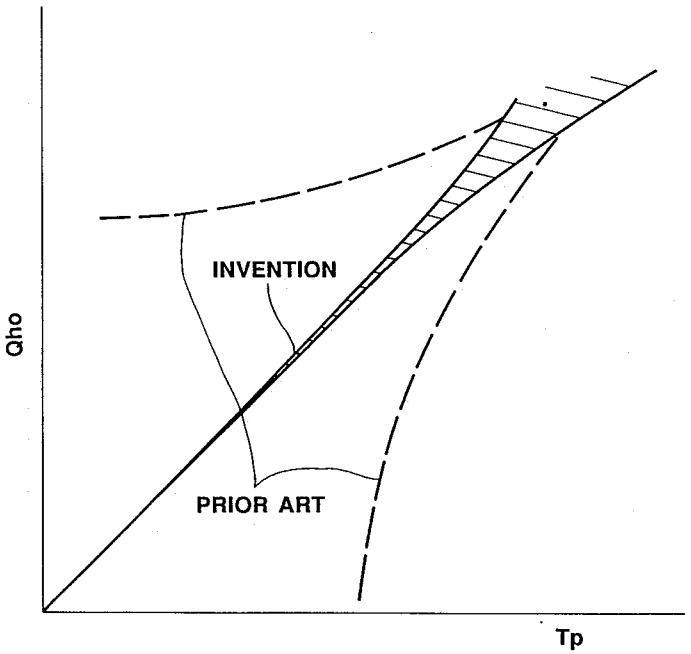
FIG. 14 is a chart showing in terms of Qho and Tp (basic injection pulse width) the improvement in control provided by the third embodiment of the invention.

FIG. 14 shows in graphical form the improvement in correlation between Qho and Tp achieved with the third embodiment. In this Figure the broken lines denote the characteristics achieved with prior art type arrangements which the solid lines denote those achieved with the third embodiment. As will be appreciated, with the self-correcting function provided with the third embodiment, a close to linear relationship is obtained until relatively high Qho and Tp values are reached.

FOURTH EMBODIMENT

A fourth embodiment of the present invention is essentially similar to the third one and differs in that, rather than determining the status of the idle switch 13 in the Gktvof derivation routine, this embodiment determines if the engine is operating under non-transitory conditions before proceeding. This embodiment however is limited to modes wherein the load on the engine is in the low-medium range wherein the boost pressure is below −150 mmHg.

The various programs via which non-transitory engine operation can be detected using the data inputs provided in system illustrated in FIG. 1, is deemed well within the purview of those skilled in the art to which the present invention pertains. Accordingly, no description of the same is deemed necessary.

The fourth embodiment thus features the advantage that the correction of the throttle position sensor output can be performed when the engine is operating under modes other than idling and thus increase the number of opportunities wherein correction can be implemented.

FIFTH EMBODIMENT

A fifth embodiment of the present invention features the addition of a carburetion factor to the calculation performed in equation the first embodiment. Viz:

$$Ti = (AvTp \div Kathos) \times Tfbya \times (æ + æm) + Ts \quad (14)$$

wherein æ m is a carburetion correction factor which is obtained by table look-up. In this embodiment this additional factor is developed in accordance with the output of the oxygen sensor and which is supplemental to the æ value in a manner which improves the response of the system to deviations from the desired air-fuel mixture.

Figure 20A:
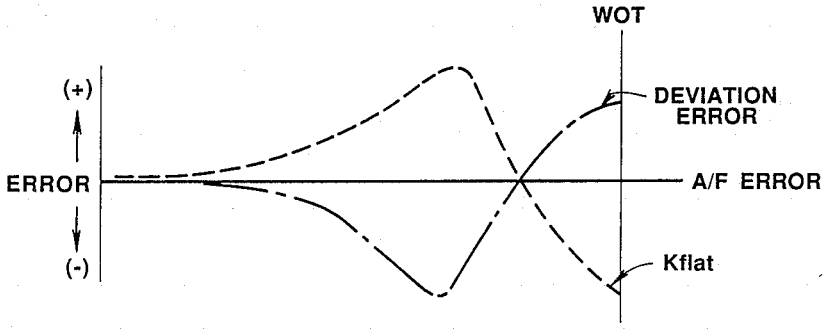
FIGS. 20A and 20B demonstrate the air-fuel ratio control possible with the fourth embodiment at normal and elevated altitudes.
Figure 20B:
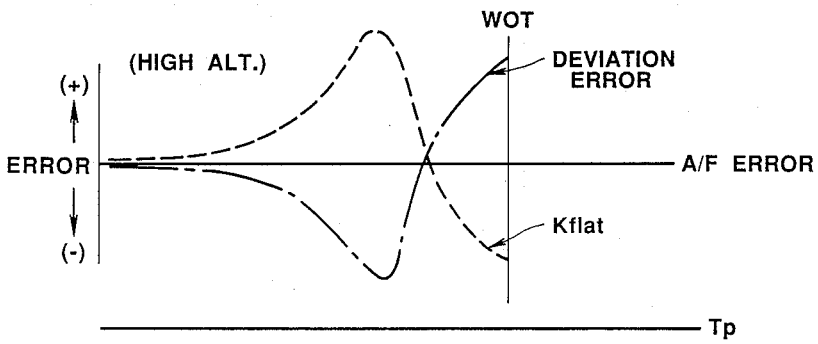

The addition of this factor improves the air-fuel ratio control as will be appreciated from FIGS. 20A and 20B, the fluctuation induced error E is offset by the Kflat factor under both normal and high altitude operation and thus induce the error in the A/F ratio to remain essentially constant at a minimum level.

Figure 15:
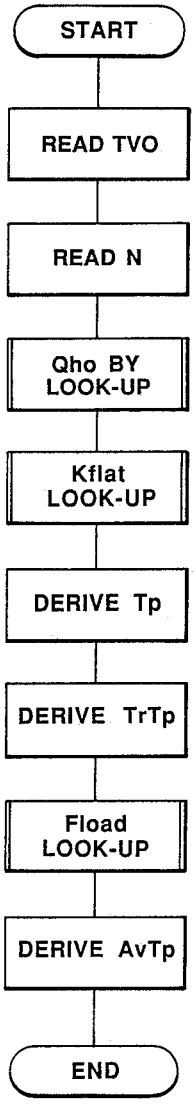
FIGS. 15 and 18 are flow charts showing steps which are executed in accordance with a fourth embodiment of the present invention.
Figure 18:
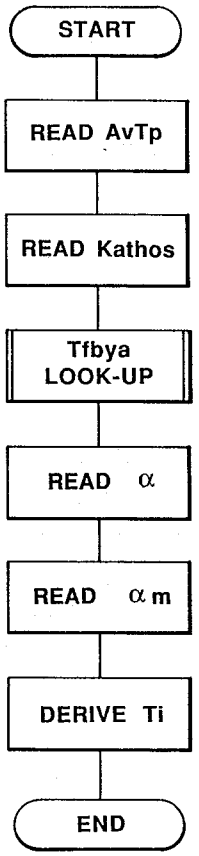
Figure 16:
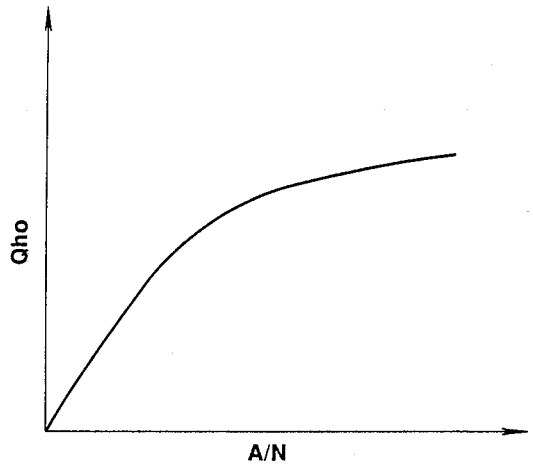
FIGS. 16 and 17 are look-up maps used in the fourth embodiment to provide values of Qho and Kflat, respectively.
Figure 17:
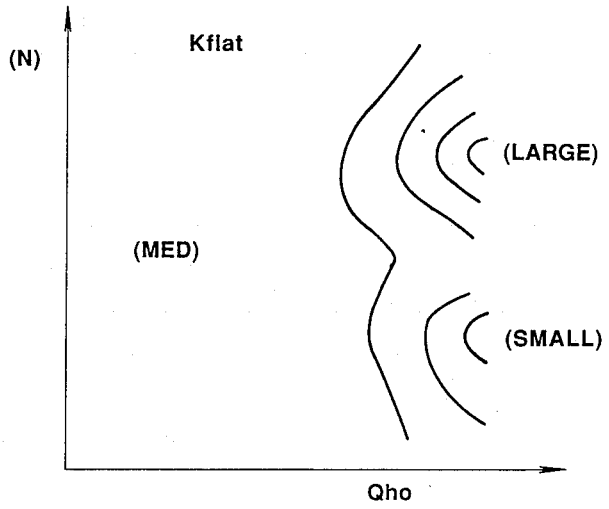

FIGS. 15 and 18 show in flow chart form the steps which are performed in order to obtain a value of AvTp and Ti respectively. FIGS. 16 and 17 show tables from which the Qho and Kflat values which are obtained.

These figures are deemed to be self-explanatory in view of the preceding disclosure whereby numerals are not assigned to each of the steps of the flow charts.

SIXTH EMBODIMENT

The sixth embodiment of the present invention actually relates to the manner in which the TrTp' factor is weighted to derive TrTp.

Figure 21:
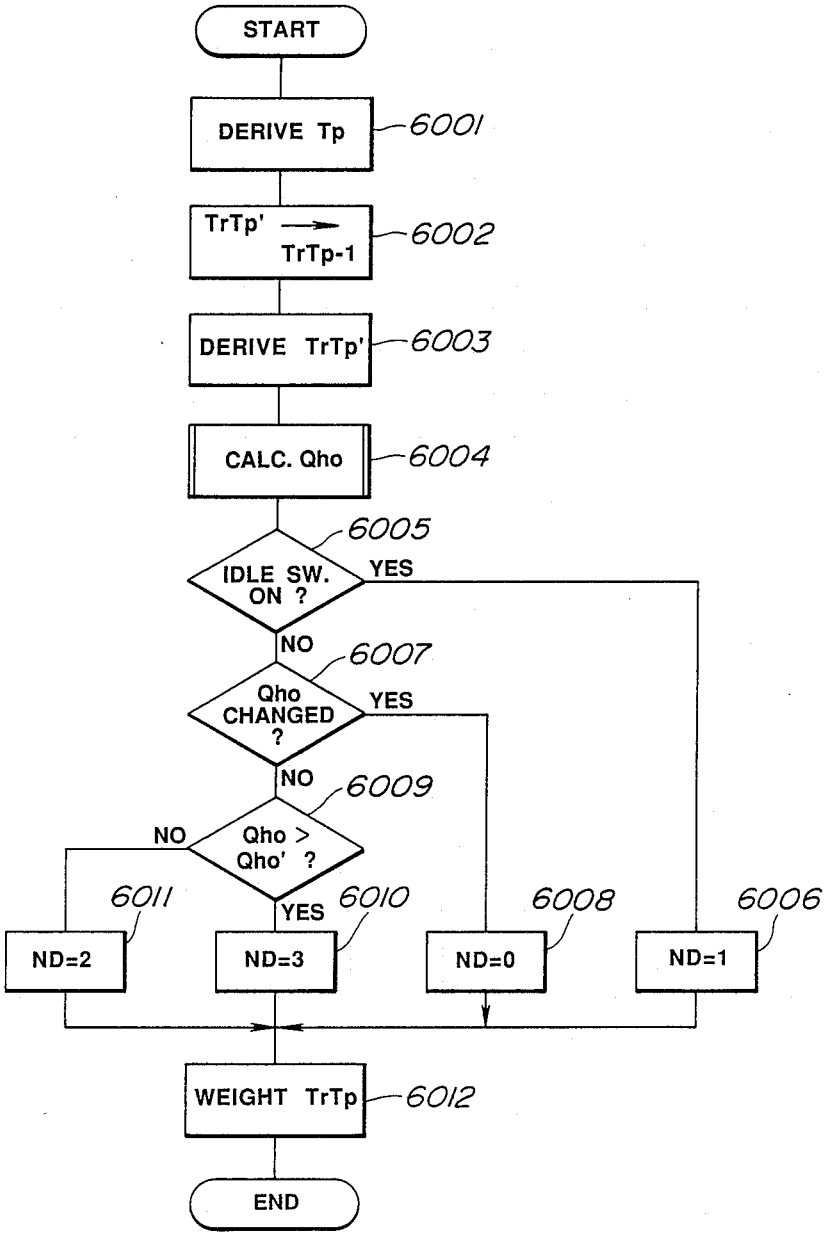
FIG. 21 is a flow chart showing the steps which characterize a sixth embodiment of the present invention wherein weighting indicia for the TrTp factor are derived based on the presence of transition, load and or WOT or near WOT engine operation.

FIG. 21 shows in flow chart form the steps which characterize the instant embodiment. In the first step 6001 of this routine Tp is derived in the manner disclosed above in connection with step 2001 of FIG. 4. At step 6002 the instant value of TrTp which is resident in memory is rewritten as TrTp−1 and subsequently in step 6003, a fresh value of TrTp' is calculated using equation (3).

At step 5004 a value of Qho is derived using the throttle position signal TVO and the engine speed N.

At step 6005 the status of idle switch 13 is determined and in the event that it is ON (indicating a no load condition), the routine flows across to step 5006 wherein a deviation smoothing index ND is set to 1 (viz., ND=1).

On the other hand, if the idle switch is OFF (indicating the presence of load) then it is determined at step 6007 if the value of Qho derived in step 6004 was derived with a predetermined period following a sudden change (viz., is in the initial stage of a transitive condition). In the event that the outcome is affirmative then the routine flows to step 6008 wherein ND=0.

However, in the event of a negative outcome (indicating either a secondary stage of transition or non-transitive operation), then at step 6009 it is determined if the instant value of Qho is equal to or above a predetermined level Qho' or not. In the event that the value is above said predetermined level, then it is assumed that the engine is operating at or near WOT and ND=3. On the other hand if, the instant induction volume is less than Qho' then the routine flows to step 6011 wherein ND=2.

At step 5012 the instant value of ND is used in equation (15).

$$TrTp=[TrTp'/2^{ND}]+[TRTp-1/1-2^{ND}] \quad (15)$$

Following this, AvTp is derived in a manner set forth previously in connection with equation (4).

SEVENTH EMBODIMENT

Figure 22:
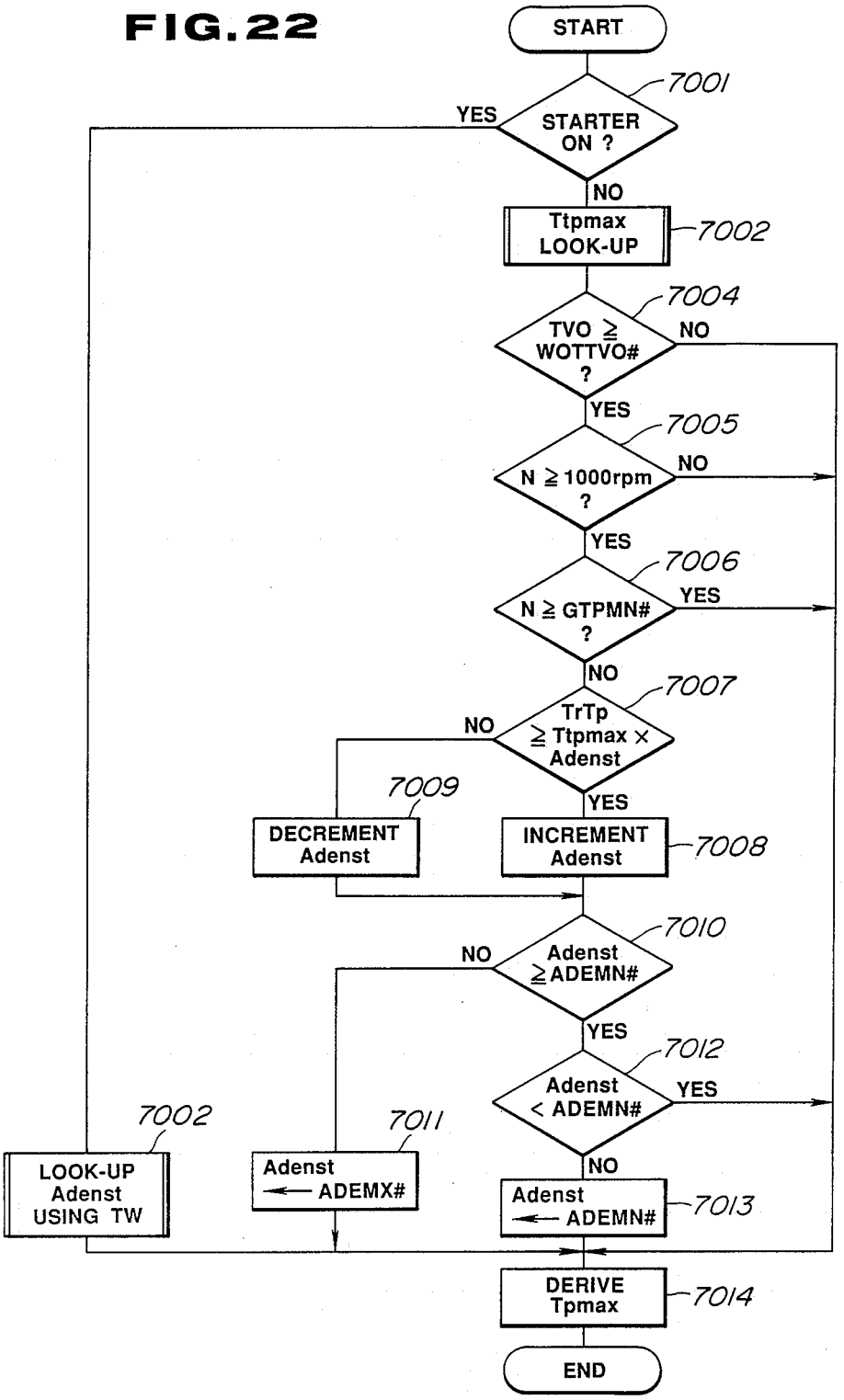
FIGS. 22 is a flow chart showing the operations performed in accordance with a seventh embodiment of the present invention.

FIG. 22 shows in flow chart from the operations which are performed by routine which characterizes a seventh embodiment of the present invention. This routine is arranged to be run a 10 ms intervals by way of example.

Figure 23:
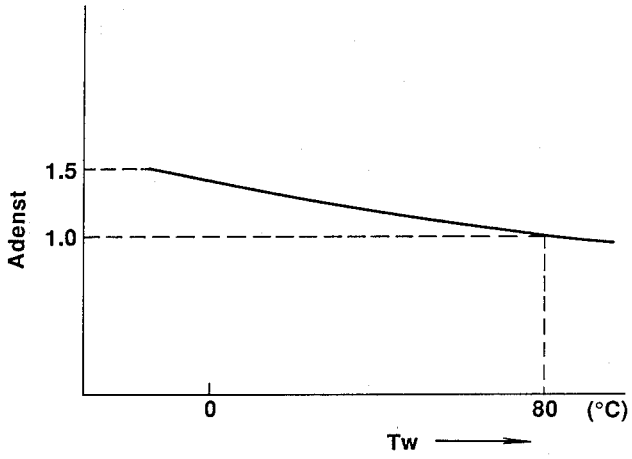

The first step of this routine 7001 is such as to determine if the engine is being cranked or is in the initial stages of being started. If the outcome of this enquiry is affirmative, then at step 7002 the instant coolant temperature TW is used in connection with pre-recorded data such as depicted in FIG. 23. to perform a table look-up in order to determine a suitable value for Adenst. It will be noted that as the engine is being cranked, the likelihood of low coolant temperatures is high and as a result it is deemed better to determine the value of Adenst on a temperature basis.

Figure 24:
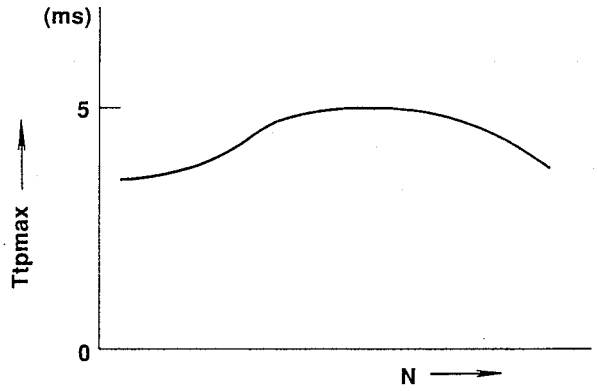

In the event that the engine is running and the starter switch is not closed (viz., engine cranking is not be induced) the routine flows to step 7002 wherein a value of Ttpmax is derived by table look-up. In this case data of the nature depicted in FIG. 24 is used.

Following this the instant throttle opening signal TVO is sampled and compared with a value WOTTVO#. In this instance, the value of WOTTVO# is selected so that when the value of TVO exceeds the same, it is possible to consider the engine as operating in a WOT mode.

As will be appreciated, when TVO<WOTTVO# it is taken that wide open throttle conditions do not exist and the routine proceeds directly to sep 7014 (discussed in more detail later). However, in the event that TVO≧WOTTVO# then the routine flows to step 7005 wherein it is determined if the engine speed is above or below a predetermined value. In this instance the value is selected to be 1000 RPM, however, as will be fully appreciated this value can be varied with engine and to suit given requirements. When the engine speed is ≧1000 RPM the routine proceeds to step 7006 wherein N (engine speed) is compared with a value GTPMN#. This value defines an upper limit which in combination with the lower one (e.g. 1000 RPM) defines an engine speed range in which the engine speed must fall before the routine proceeds to step 7007 wherein the value of the flat A/F corrected pulse width TrTp which is resident in memory is compared with the product of Ttpmax×Adenst.

In the event that TrTp is larger than the just mentioned product, the routine flows to step 7009 wherein the value of Adenst derived on the previous run of the program (viz., Adenst−1) is increment by a predetermined amount DADENA#. On the other hand in the case TrTp is lower, at step 7009 Adenst−1 is decremented by a value DADENS#.

Following this, at steps 7010 and 7012 it is determined if the modified value of Adenst falls in a predetermined range defined between ADEMX# and ADEMN#. In the event that Adenst<ADEMX# then at step 7011 then the value of Adenst is set equal to ADEMX# while in the event that it is greater than ADEMN# then in step 7013 the value of Adenst is set equal to ADEMN#.

In step 7014 the value of Tpmax which defines the upper limit of AtTp is derived using equation (17).

$$Tpmax=Ttpmax\times Kquo\times Adenst+YUTORI\# \quad (16)$$

wherein -

Kqho: is a value which is derived using the data depicted by the solid line trace in FIG. 25. It will be noted that the case the data which defines the broken line trace is used, the addition of the YUTORI# can be dispensed with.

Following the derivation of Tpmax as above, AvTp is derived in a manner essentially similar to that disclosed previously in connection with the flow chart shown in FIG. 10.

FIG. 26 shows the control characteristics provided with the instant embodiment. As will be appreciated from FIG. 26 (B) the change in air-fuel ratio in response to changes in AvTp is minimal due to the limiting effect of Tpmax. At high altitudes, the level of Tpmax is lowered in a manner to suitably control the A/F control.

As a result the level of noxious exhaust emissions tends to be maintained at the minimum level under all modes of engine operation.

What is claimed is:

1. In an method of operating an internal combustion engine sensing the amount of air flowing in an induction conduit using an air-flow meter;

throttling of said induction conduit using a throttle valve, said throttle valve being disposed in said air induction conduit at a location downstream of said air-flow meter;

sensing the position of said throttle valve using a throttle valve position sensor, said throttle valve position sensor being operatively connected with said throttle valve and arranged to output a signal indicative of the opening degree thereof;

injecting fuel into said induction conduit using a fuel injector, said fuel injector being disposed in said air induction conduit at a location proximate the downstream end thereof;

sensing the rotational speed of said engine using a rotational speed sensor, said rotational speed sensor being operatively connected with said engine and arranged to output a signal indicative of the rotational speed thereof;

deriving a basic injection pulse width (Tp) based on the output of said air-flow meter and said engine speed sensor (Qa/N);

deriving an air induction amount (Qho) based on the output of said throttle valve position sensor and said rotational speed sensor (TVO/N);

smoothing the result of the basic injection pulse width derivation using a smoothing factor which varies with the output of said engine speed and said derived air induction amount;

deriving a correction pulse width based on the change in a first intermediate value (TTHSTP) which varies with said rotational speed sensor output and said derived air induction amount; and adding the correction pulse width to said basic pulse width to derive a corrected pulse width (AvTp); and limiting the maximum value of said corrected pulse width to a maximum value (Tpmax).

2. A method as claimed in claim 1 further comprising the steps of:

deriving the maximum value by which said corrected pulse width is limited by;

obtaining a second temporary value which varies with engine speed; and multiplying this second temporary valve with a third temporary value which is indicative of the density of the air being inducted.

3. A method as claimed in claim 2 further comprising the step of:

adding a fourth temporary value indicative of a predetermined amount leeway or freedom to the product of said second and third temporary values.

4. A method as claimed in claim 1 further comprising the steps of:

determining the engine is operating under predetermined non-transitory conditions;

comparing the basic pulse width with the derived air induction amount; and developing a correction factor which is applied to the signal produced by said throttle position sensor.

5. A method as claimed in claim 3 further comprising the steps of:

developing weighting factors; and selectively applying said weighting factors in a manner which improves the air-fuel control of said engine.

6. In an internal combustion engine an air-flow meter, said air-flow meter being disposed in an air induction conduit of the engine;

a throttle valve, said throttle valve being disposed in said air induction conduit at a location downstream of said air-flow meter;

a throttle valve position sensor, said throttle valve sensor being operatively connected with said throttle valve and arranged to output a signal indicative of the opening degree of said throttle valve;

a fuel injector, said fuel injector being disposed in said air induction conduit at a location proximate the downstream end thereof;

a rotational speed sensor, said rotational speed sensor being operatively connected with said engine and arranged to output a signal indicative of the rotational speed of said engine;

a control circuit, said control circuit including circuitry responsive to said air flow meter and said throttle valve position sensor, said control circuit further including means for:

deriving a basic injection pulse width (Tp) based on the output of said air-flow meter and said engine speed sensor (Qa/N);

deriving an air induction amount (Qho) based on the output of said throttle valve position sensor and said rotational speed sensor (TVO/N);

smoothing the result of the basic injection pulse width derivation using a smoothing factor which varies with the output of said engine speed and said derived air induction amount;

deriving a correction pulse width based on the change in a first intermediate value (TTHSTP) which varies with said rotational speed sensor output and said derived air induction amount; and adding the correction pulse width to said basic pulse width to derive a corrected pulse width (AvTp);

limiting the maximum value of said corrected pulse width to a maximum value (Tpmax).

7. An internal combustion engine as claimed in claim 6 further comprising:

means for deriving the maximum value by which said corrected pulse width is limited by;

means for obtaining a second temporary value which varies with engine speed; and means for multiplying this second temporary valve with a third temporary value which is indicative of the density of the air being inducted.

8. An internal combustion engine as claimed in claim 7 further comprising:

means for adding a fourth temporary value indicative of a predetermined amount leeway or freedom to the product of said second and third temporary values.

9. An internal combustion engine as claimed in claim 6 further comprising:

means for determining the engine is operating under predetermined non-transitory conditions;

means for comparing the basic pulse width with the derived air induction amount; and means for developing a correction factor which is applied to the signal produced by said throttle position sensor.

10. An internal combustion engine as claimed in claim 6 further comprising:

means for developing weighting factors; and means for selectively applying said weighting factors in a manner which improves the air-fuel control of said engine.

* * * * *